US010192509B2

(12) United States Patent
Lee et al.

(10) Patent No.: US 10,192,509 B2
(45) Date of Patent: Jan. 29, 2019

(54) DISPLAY APPARATUS AND A METHOD OF OPERATING THE SAME

(71) Applicant: SAMSUNG DISPLAY CO., LTD., Yongin-si, Gyeonggi-Do (KR)

(72) Inventors: Jaehoon Lee, Seoul (KR); Jai-Hyun Koh, Yongin-si (KR); Chang Sin Kim, Suwon-si (KR); Bonghyun You, Seongnam-si (KR); Jeong Bong Lee, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 59 days.

(21) Appl. No.: 15/403,646

(22) Filed: Jan. 11, 2017

(65) Prior Publication Data

US 2017/0256228 A1 Sep. 7, 2017

(30) Foreign Application Priority Data

Mar. 3, 2016 (KR) ..... 10-2016-0025942

(51) Int. Cl.
*G09G 3/36* (2006.01)

(52) U.S. Cl.
CPC ..... *G09G 3/3688* (2013.01); *G09G 3/3614* (2013.01); *G09G 3/3677* (2013.01); *G09G 3/3696* (2013.01); *G09G 2300/0426* (2013.01); *G09G 2310/027* (2013.01); *G09G 2310/0291* (2013.01); *G09G 2310/08* (2013.01)

(58) Field of Classification Search
CPC .. G09G 3/3677; G09G 3/3688; G09G 3/3696; G09G 2310/08; G09G 2310/027; G09G 2310/0291
See application file for complete search history.

(56) References Cited

U.S. PATENT DOCUMENTS 6,335,721 B1 * 1/2002 Jeong ..... G09G 3/3614 345/100
6,469,684 B1 * 10/2002 Cole ..... G09G 3/3614 345/58

(Continued)

FOREIGN PATENT DOCUMENTS

KR 1020150073491 7/2015
KR 1020150077181 7/2015

*Primary Examiner* — Antonio Xavier
(74) *Attorney, Agent, or Firm* — F. Chau & Associates, LLC

(57) ABSTRACT

A display apparatus includes a timing controller, a data driver and a display panel. The timing controller generates a mode selection signal and output image data in response to input image data. The data driver generates first through N-th data voltages in response to the mode selection signal and the output image data and applies the first through N-th data voltages to first through N-th data lines. The display panel is connected to the first through N-th data lines. During the first operation mode, each of a polarity pattern of first through M-th data voltages and a polarity pattern of (M+1)-th through N-th data voltages repeats a first polarity pattern. During the second operation mode, the polarity pattern of the first through M-th data voltages repeats the first polarity pattern, and the polarity pattern of the (M+1)-th through N-th data voltages repeats a second polarity pattern.

17 Claims, 16 Drawing Sheets

(56) References Cited

U.S. PATENT DOCUMENTS 6,680,722 B1 * 1/2004 Hiraki ..... G09G 3/2011 345/87
8,368,629 B2 * 2/2013 Jung ..... G09G 3/3688 345/204
8,427,415 B2 * 4/2013 Morita ..... G09G 3/3688 345/100
8,970,573 B2 * 3/2015 Knausz ..... H03M 1/661 341/144
9,172,390 B2 * 10/2015 Cheng ..... H03M 1/66
2004/0239602 A1 * 12/2004 Kim ..... G09G 3/3611 345/87
2005/0200587 A1 * 9/2005 Hwang ..... G09G 3/3614 345/96
2006/0028426 A1 * 2/2006 Hiratsuka ..... G09G 3/3614 345/103
2007/0069214 A1 * 3/2007 Lee ..... G09G 3/3648 257/72
2008/0129904 A1 * 6/2008 Kang ..... G09G 3/3648 349/37
2008/0170025 A1 * 7/2008 Song ..... G09G 3/3614 345/96
2008/0211703 A1 * 9/2008 Tsuchi ..... G09G 3/3685 341/144
2009/0021462 A1 * 1/2009 Furihata ..... G09G 3/2011 345/89
2009/0295777 A1 * 12/2009 Wang ..... G09G 3/3614 345/212
2011/0012887 A1 1/2011 Lee et al.
2011/0025664 A1 * 2/2011 Liao ..... G09G 3/3614 345/209
2011/0164076 A1 * 7/2011 Lee ..... G09G 3/3406 345/691
2011/0234653 A1 * 9/2011 Ueda ..... G09G 3/3688 345/690
2012/0162165 A1 * 6/2012 Lee ..... G09G 3/006 345/206
2012/0162183 A1 * 6/2012 Kwon ..... G09G 3/3614 345/212
2012/0229434 A1 * 9/2012 Niibo ..... G09G 3/293 345/204
2014/0132580 A1 * 5/2014 Hu ..... G09G 3/3614 345/209
2014/0198019 A1 * 7/2014 Wei ..... G09G 3/3614 345/87
2014/0354606 A1 * 12/2014 Chen ..... G09G 5/18 345/204
2015/0248865 A1 * 9/2015 Lim ..... G09G 3/3696 345/691
2016/0086552 A1 * 3/2016 Namkung ..... G09G 3/3607 345/694
2016/0335966 A1 * 11/2016 Kumagai ..... G09G 3/3614

* cited by examiner

DISPLAY APPARATUS AND A METHOD OF OPERATING THE SAME

CROSS-REFERENCE TO RELATED APPLICATION

This application claims priority under 35 U.S.C. § 119 to Korean Patent Application No. 10-2016-0025942, filed on Mar. 3, 2016 in the Korean Intellectual Property Office (KIPO), the disclosure of which is incorporated by reference herein in its entirety.

TECHNICAL FIELD

Exemplary embodiments of the present inventive concept relate generally to displaying images, and more particularly to display apparatuses and methods of operating the display apparatuses.

DESCRIPTION OF THE RELATED ART

A liquid crystal display (LCD) apparatus may include a first substrate including a pixel electrode, a second substrate including a common electrode and a liquid crystal layer located between the first and second substrates. An electric field may be generated by applying voltages to the pixel electrode and the common electrode. By adjusting an intensity of the electric field, a transmittance of light passing through the liquid crystal layer may be adjusted, and thus, an image may be displayed.

When an electric field having a uniform direction is continuously applied to the liquid crystal layer, a characteristic of a liquid crystal may be degraded. An inversion driving scheme may help to reduce or prevent the degradation of the characteristic of the liquid crystal. In the inversion driving scheme, a polarity of a data voltage applied to the liquid crystal is reversed with respect to a common voltage for a set of data voltages or a predetermined period. However, in a display panel operating based on the inversion driving scheme, crosstalk may impact the quality of an image displayed on the display panel.

SUMMARY

According to an exemplary embodiment of the present inventive concept, a display apparatus includes a timing controller, a first data driver and a display panel. The timing controller generates a mode selection signal and output image data in response to input image data. The mode selection signal indicates a first operation mode or a second operation mode. The first data driver generates first through M-th data voltages and (M+1)-th through N-th data voltages in response to the mode selection signal and the output image data, where M is a natural number, and N is a natural number greater than M. The first data driver applies the first through N-th data voltages to first through N-th data lines, respectively. The display panel is connected to the first through N-th data lines. During a first duration of the first operation mode, each of a polarity pattern of the first through M-th data voltages and a polarity pattern of the (M+1)-th through N-th data voltages repeats a first polarity pattern. During a first duration of the second operation mode, the polarity pattern of the first through M-th data voltages repeats the first polarity pattern, and the polarity pattern of the (M+1)-th through N-th data voltages repeats a second polarity pattern different from the first polarity pattern.

In an exemplary embodiment of the present inventive concept, the first polarity pattern may include at least one first polarity and at least one second polarity that are arranged in a first order. The second polarity pattern may include the at least one first polarity and the at least one second polarity that are arranged in a second order different from the first order.

In an exemplary embodiment of the present inventive concept, the first polarity may be a positive polarity with respect to a common voltage, and the second polarity may be a negative polarity with respect to the common voltage.

In an exemplary embodiment of the present inventive concept, during a second duration of the first operation mode subsequent to the first duration of the first operation mode, each of the polarity pattern of the first through M-th data voltages and the polarity pattern of the (M+1)-th through N-th data voltages may repeat the second polarity pattern. During a second duration of the second operation mode subsequent to the first duration of the second operation mode, the polarity pattern of the first through M-th data voltages may repeat the second polarity pattern, and the polarity pattern of the (M+1)-th through N-th data voltages may repeat the first polarity pattern.

In an exemplary embodiment of the present inventive concept, the first data driver may include a digital-to-analog converter and an output buffer. The digital-to-analog converter may generate the first through N-th data voltages in response to the mode selection signal, a polarity control signal and the output image data. The output buffer may output the first through N-th data voltages to the first through N-th data lines.

In an exemplary embodiment of the present inventive concept, M may be about a half of N.

In an exemplary embodiment of the present inventive concept, the first through N-th data voltages may be generated in units of X in response to the polarity control signal, where X is a natural number equal to or greater than two. M may be a multiple of X and may be about a half of N.

In an exemplary embodiment of the present inventive concept, the first data driver may include a digital-to-analog converter and an output buffer. The digital-to-analog converter may generate first through N-th voltage values in response to the output image data. The output buffer may output the first through N-th data voltages to the first through N-th data lines in response to the mode selection signal, a polarity control signal and the first through N-th voltage values.

In an exemplary embodiment of the present inventive concept, the output buffer may include first through N-th buffers. The first buffer may include a first buffer unit, a second buffer unit and a switch unit. The first buffer unit may generate a first internal data voltage having a first polarity in response to the first voltage value. The second buffer unit may generate a second internal data voltage having a second polarity in response to the first voltage value. The switch unit may output one of the first and second internal data voltages as the first data voltage in response to the mode selection signal and the polarity control signal.

In an exemplary embodiment of the present inventive concept, the display apparatus may further include a second data driver and a third data driver. The second data driver may generate (N+1)-th through K-th data voltages and (K+1)-th through L-th data voltages in response to the mode selection signal and the output image data, where K is a natural number greater than N and L is a natural number greater than K. The second data driver may apply the (N+1)-th through L-th data voltages to (N+1)-th through L-th data lines, respectively. The third data driver may generate (L+1)-th through I-th data voltages and (I+1)-th through J-th data voltages in response to the mode selection signal and the output image data, where I is a natural number greater than L and J is a natural number greater than I. The third data driver may apply the (L+1)-th through J-th data voltages to (L+1)-th through J-th data lines, respectively. The display panel may be connected to the (N+1)-th through L-th data lines and the (L+1)-th through J-th data lines.

In an exemplary embodiment of the present inventive concept, during the first duration of the second operation mode, a polarity pattern of the (N+1)-th through K-th data voltages may repeat the second polarity pattern, and a polarity pattern of the (K+1)-th through L-th data voltages may repeat the first polarity pattern.

In an exemplary embodiment of the present inventive concept, during the first duration of the second operation mode, a polarity pattern of the (L+1)-th through I-th data voltages may repeat the first polarity pattern, and a polarity pattern of the (I+1)-th through J-th data voltages may repeat the second polarity pattern.

In an exemplary embodiment of the present inventive concept, the display panel may include a first pixel and a second pixel. The first pixel may be connected to the first data line and a first gate line. The second pixel may be adjacent to the first pixel, and may be connected to the first data line and a second gate line adjacent to the first gate line.

In an exemplary embodiment of the present inventive concept, the display apparatus may operate in the second operation mode when a first image displayed in response to the input image data includes a predetermined pattern. The display apparatus may operate in the first operation mode when the first image does not include the predetermined pattern.

According to an exemplary embodiment of the present inventive concept, in a method of operating a display apparatus including a display panel, a mode selection signal and output image data are generated in response to input image data. The mode selection signal identifies a first operation mode or a second operation mode. First through M-th data voltages and (M+1)-th through N-th data voltages are generated in response to the mode selection signal and the output image data, where M is a natural number and N is a natural number greater than M. The first through N-th data voltages are applied to first through N-th data lines connected to the display panel, respectively. During a first duration of the first operation mode, each of a polarity pattern of the first through M-th data voltages and a polarity pattern of the (M+1)-th through N-th data voltages repeats a first polarity pattern. During a first duration of the second operation mode, the polarity pattern of the first through M-th data voltages repeats the first polarity pattern, and the polarity pattern of the (M+1)-th through N-th data voltages repeats a second polarity pattern different from the first polarity pattern.

In an exemplary embodiment of the present inventive concept, the first polarity pattern may include at least one first polarity and at least one second polarity that are arranged in a first order. The second polarity pattern may include the at least one first polarity and the at least one second polarity that are arranged in a second order different from the first order.

In an exemplary embodiment of the present inventive concept, M may be about a half of N.

In an exemplary embodiment of the present inventive concept, the first through N-th data voltages may be generated in units of X, where X is a natural number equal to or greater than two. M may be a multiple of X and may be about a half of N.

In an exemplary embodiment of the present inventive concept, (N+1)-th through K-th data voltages and (K+1)-th through L-th data voltages may be generated in response to the mode selection signal and the output image data, where K is a natural number greater than N and L is a natural number greater than K. (L+1)-th through I-th data voltages and (I+1)-th through J-th data voltages may be generated in response to the mode selection signal and the output image data, where I is a natural number greater than L and J is a natural number greater than I. The (N+1)-th through L-th data voltages may be applied to (N+1)-th through L-th data lines connected to the display panel, respectively. The (L+1)-th through J-th data voltages may be applied to (L+1)-th through J-th data lines connected to the display panel, respectively.

In an exemplary embodiment of the present inventive concept, during the first duration of the second operation mode, a polarity pattern of the (N+1)-th through K-th data voltages may repeat the second polarity pattern, a polarity pattern of the (K+1)-th through L-th data voltages may repeat the first polarity pattern, a polarity pattern of the (L+1)-th through I-th data voltages may repeat the first polarity pattern, and a polarity pattern of the (I+1)-th through J-th data voltages may repeat the second polarity pattern.

According to an exemplary embodiment of the present inventive concept, a method of operating a display apparatus including a display panel includes: generating a first group of data voltages having a first polarity pattern in a first operation mode and a second group of data voltages having the first polarity pattern in the first operation mode; applying the first group of data voltages to a first group of data lines of the display panel and applying the second group of data voltages to a second group of data lines of the display panel; generating a third group of data voltages having the first polarity pattern in a second operation mode and a fourth group of data voltages having a second polarity pattern in the second operation mode, wherein the second polarity pattern is different from the first polarity pattern; and applying the third group of data voltages to first group of data lines of the display panel and applying the fourth group of data voltages to the second group of data lines of the display panel.

In an exemplary embodiment of the present inventive concept, the first polarity pattern includes at least one first polarity and at least one second polarity arranged in a first order, and the second polarity pattern includes the at least one first polarity and the at least one second polarity arranged in a second order opposite to the first order.

In an exemplary embodiment of the present inventive concept, the first operation mode is a normal mode and the second operation mode is a pattern detection function mode.

In an exemplary embodiment of the present inventive concept, in the pattern detection function mode a predetermined crosstalk inducing pattern is detected.

BRIEF DESCRIPTION OF THE DRAWINGS

The above and other features of the present inventive concept will become more apparent by describing in detail exemplary embodiments thereof with reference to the accompanying drawings.

DETAILED DESCRIPTION OF THE EMBODIMENTS

Figure 1:
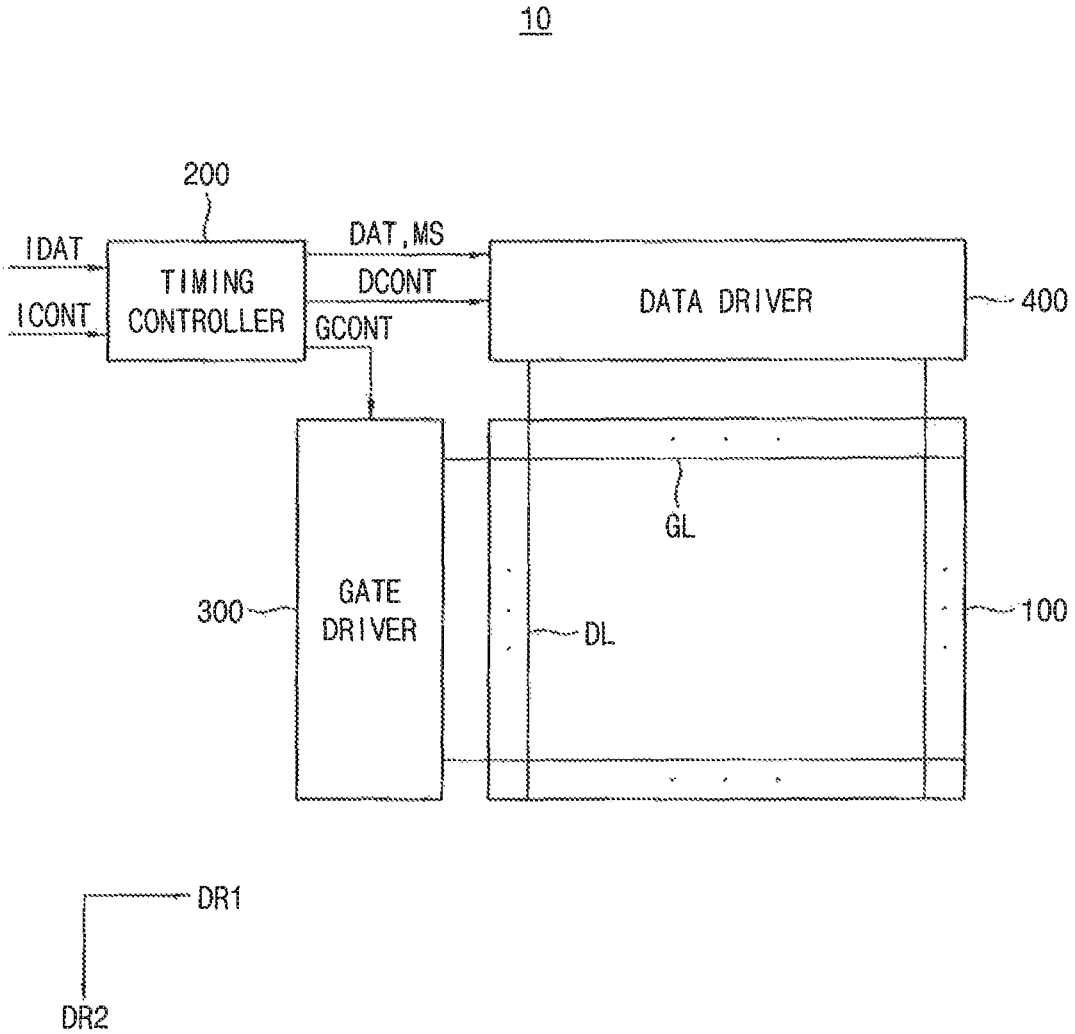
FIG. 1 is a block diagram illustrating a display apparatus according to an exemplary embodiment of the present inventive concept.

Various exemplary embodiments of the present inventive concept will be described more fully hereinafter with reference to the accompanying drawings. This inventive concept may, however, be embodied in many different forms and should not be construed as limited to the embodiments set forth herein. Like reference numerals may refer to like elements throughout this application.

FIG. 1 is a block diagram illustrating a display apparatus according to an exemplary embodiment of the present inventive concept.

Referring to FIG. 1, a display apparatus 10 includes a display panel 100, a timing controller 200, a gate driver 300 and a data driver 400. The elements of the display apparatus 10 may be composed of circuits.

The display panel 100 operates (e.g., displays an image) based on output image data DAT. The display panel 100 is connected to a plurality of gate lines GL and a plurality of data lines DL. The gate lines GL may extend in a first direction DR1, and the data lines DL may extend in a second direction DR2 crossing (e.g., substantially perpendicular to) the first direction DR1. The display panel 100 may include a plurality of pixels that are arranged in a matrix. Each pixel may be electrically connected to a respective one of the gate lines GL and a respective one of the data lines DL.

The timing controller 200 controls an operation of the display panel 100, and controls operations of the gate driver 300 and the data driver 400. The timing controller 200 receives input image data IDAT and an input control signal ICONT from an external device (e.g., a host or a graphic processor). The input image data IDAT may include a plurality of pixel data for the plurality of pixels. The input control signal ICONT may include a master clock signal, a data enable signal, a vertical synchronization signal, a horizontal synchronization signal, etc.

The timing controller 200 generates the output image data DAT and a mode selection signal MS based on the input image data IDAT. The timing controller 200 generates a first control signal GCONT based on the input control signal ICONT. The first control signal GCONT may be provided to the gate driver 300, and a driving timing of the gate driver 300 may be controlled based on the first control signal GCONT. The first control signal GCONT may include a vertical start signal, a gate clock signal, etc. The timing controller 200 generates a second control signal DCONT based on the input control signal ICONT. The second control signal DCONT may be provided to the data driver 400, and a driving timing of the data driver 400 may be controlled based on the second control signal DCONT. The second control signal DCONT may include a horizontal start signal, a data clock signal, a polarity control signal, a data load signal, etc.

The gate driver 300 generates a plurality of gate signals for driving the gate lines GL based on the first control signal GCONT. The gate driver 300 may sequentially provide the gate signals to the gate lines GL. For example, the gate driver 300 may include a plurality of shift registers.

The data driver 400 generates a plurality of data voltages (e.g., analog voltages) based on the output image data DAT (e.g., digital data), the second control signal DCONT and the mode selection signal MS. The data driver 400 may sequentially provide the data voltages to the data lines DL.

In an exemplary embodiment of the present inventive concept, the gate driver 300 and/or the data driver 400 may be disposed, e.g., directly mounted, on the display panel 100, or may be connected to the display panel 100 in a tape carrier package (TCP) type. In addition, the gate driver 300 and/or the data driver 400 may be integrated on the display panel 100.

The display apparatus 10 according to an exemplary embodiment of the present inventive concept may operate based on an inversion driving scheme in which a polarity of a data voltage applied to each pixel is reversed with respect to a common voltage for a set of data voltages or a predetermined period (e.g., at every frame). A characteristic of liquid crystals in the display panel 100 can be preserved due to the inversion driving scheme. In an exemplary embodiment of the present inventive concept, the display panel 100 may have a polarity pattern of a dot or a diagonal inversion where a single pixel is surrounded on its top, bottom, left and right by pixels having a polarity opposite to that of the single pixel. In addition, the display panel 100 may have a polarity pattern of a line inversion (e.g., a column inversion or a row inversion) where pixels in a single column or a row have the same polarity as each other.

In the display apparatus 10 according to an exemplary embodiment of the present inventive concept, the mode selection signal MS represents one of a first operation mode and a second operation mode. The data driver 400 may control a polarity pattern of the data voltages applied to the data lines DL based on the mode selection signal MS (e.g., based on an operation mode of the display apparatus 10).

Hereinafter, an operation of the display apparatus 10 according to an exemplary embodiment of the present inventive concept will be described in detail based on the operation mode of the display apparatus 10.

FIGS. 2A, 2B, 2C, 2D, 3A and 3B are diagrams for describing an operation of the display apparatus according to exemplary embodiments of the present inventive concept.

Figure 2A:
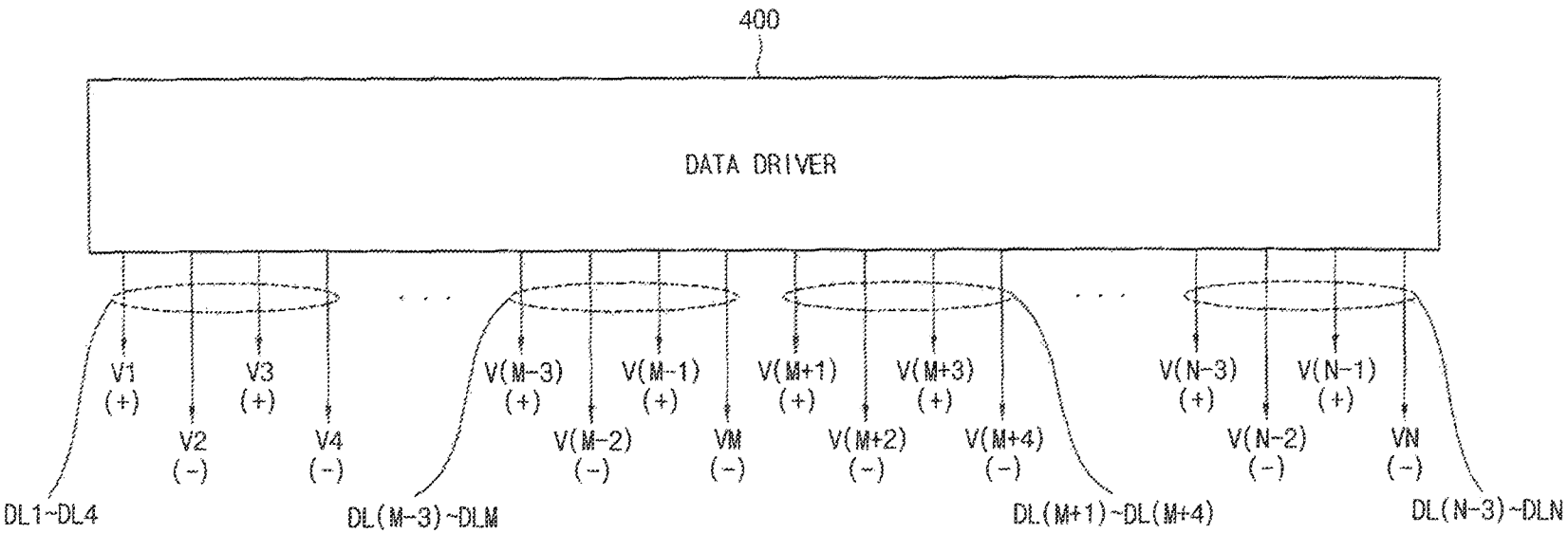
FIGS. 2A, 2B, 2C, 2D, 3A and 3B are diagrams for describing an operation of the display apparatus according to exemplary embodiments of the present inventive concept.
Figure 2B:
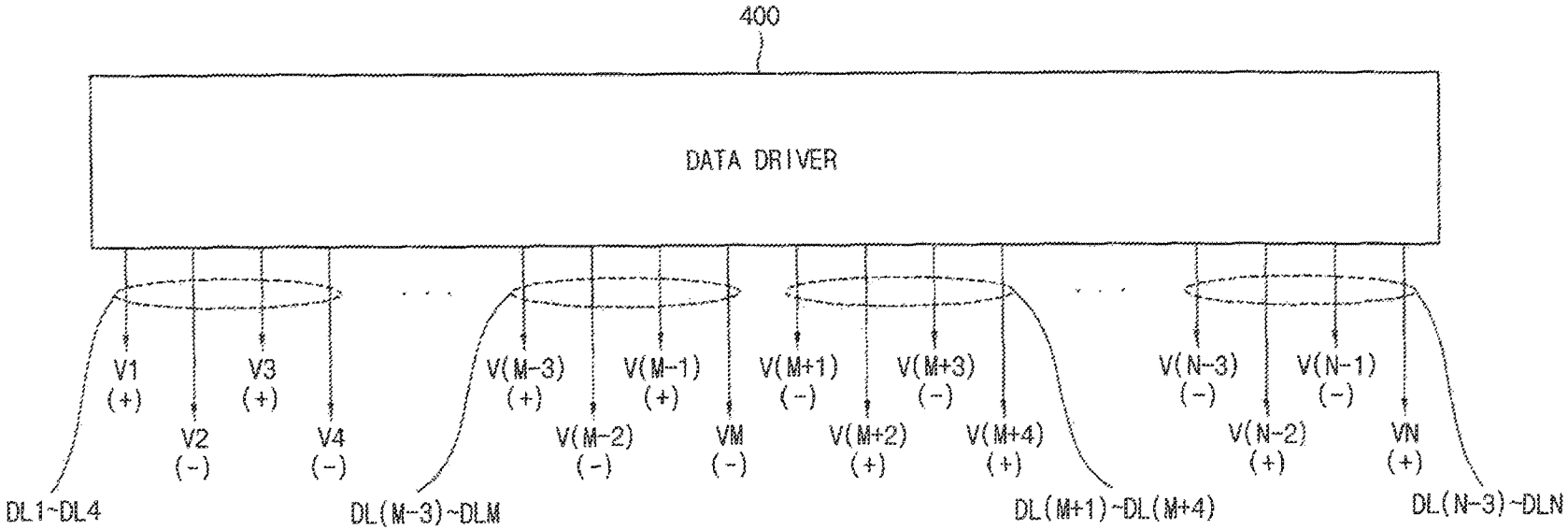
Figure 2C:
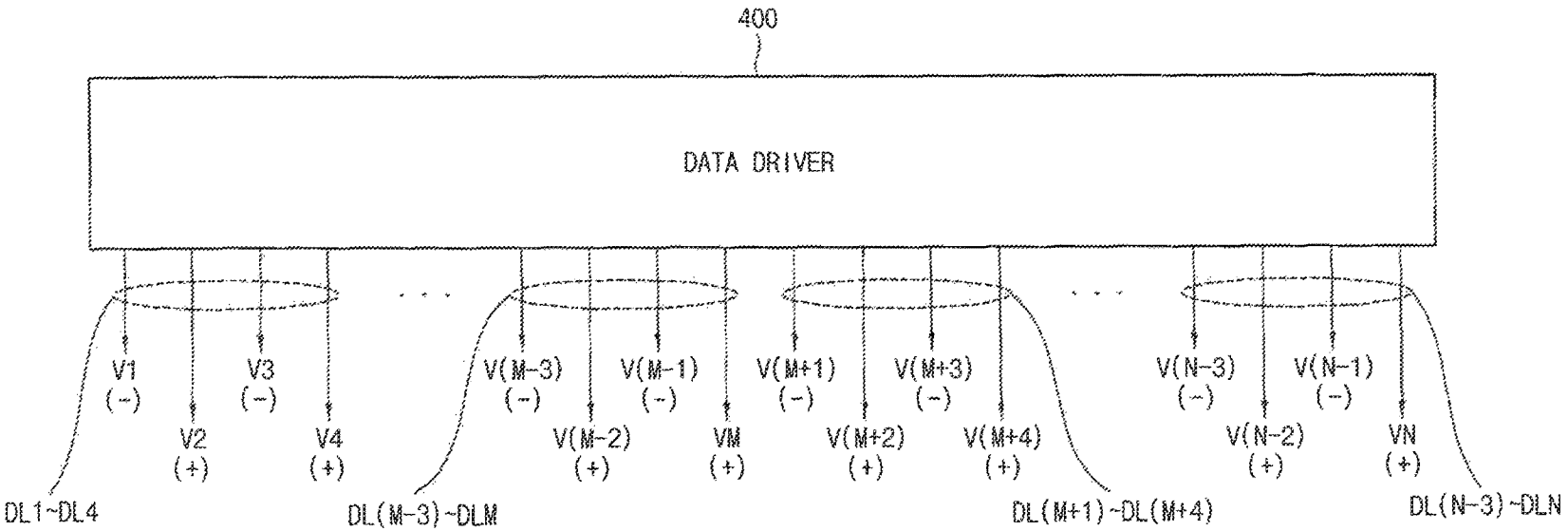
Figure 2D:
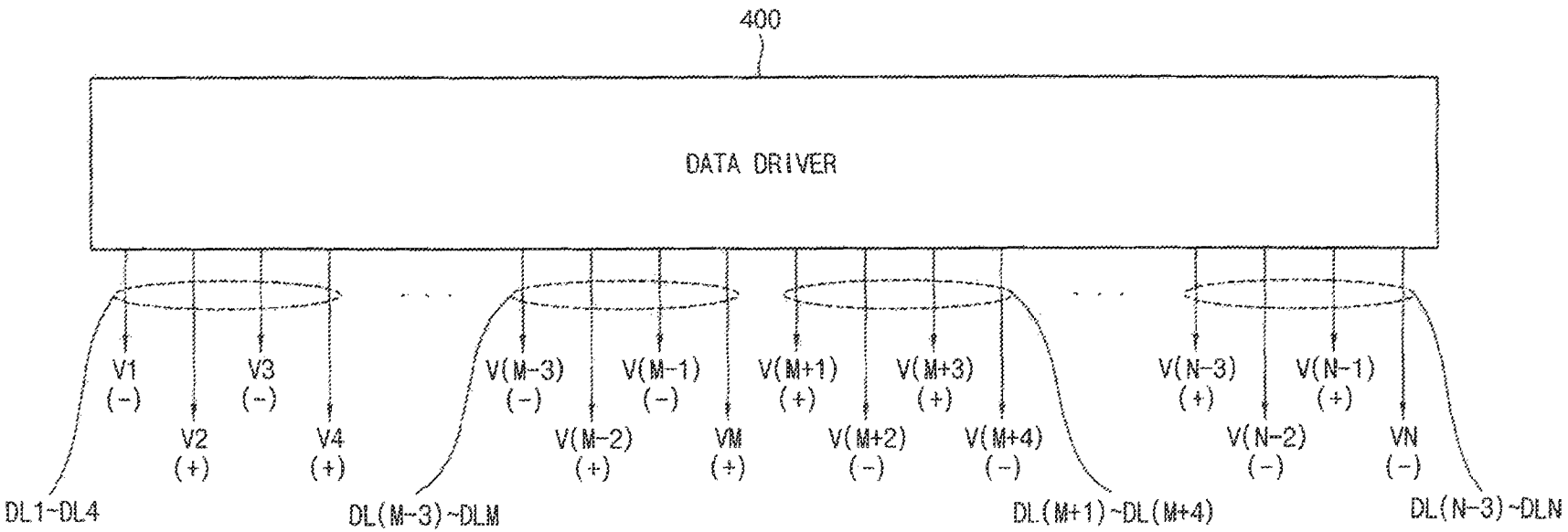
Figure 3A:
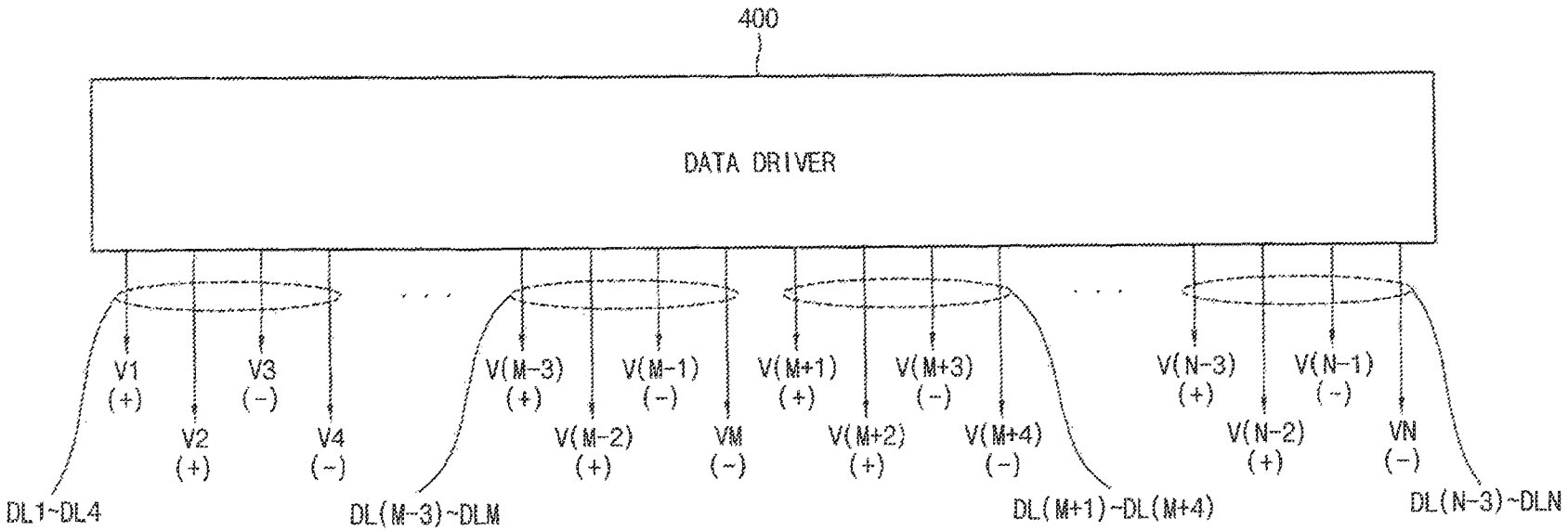
Figure 3B:
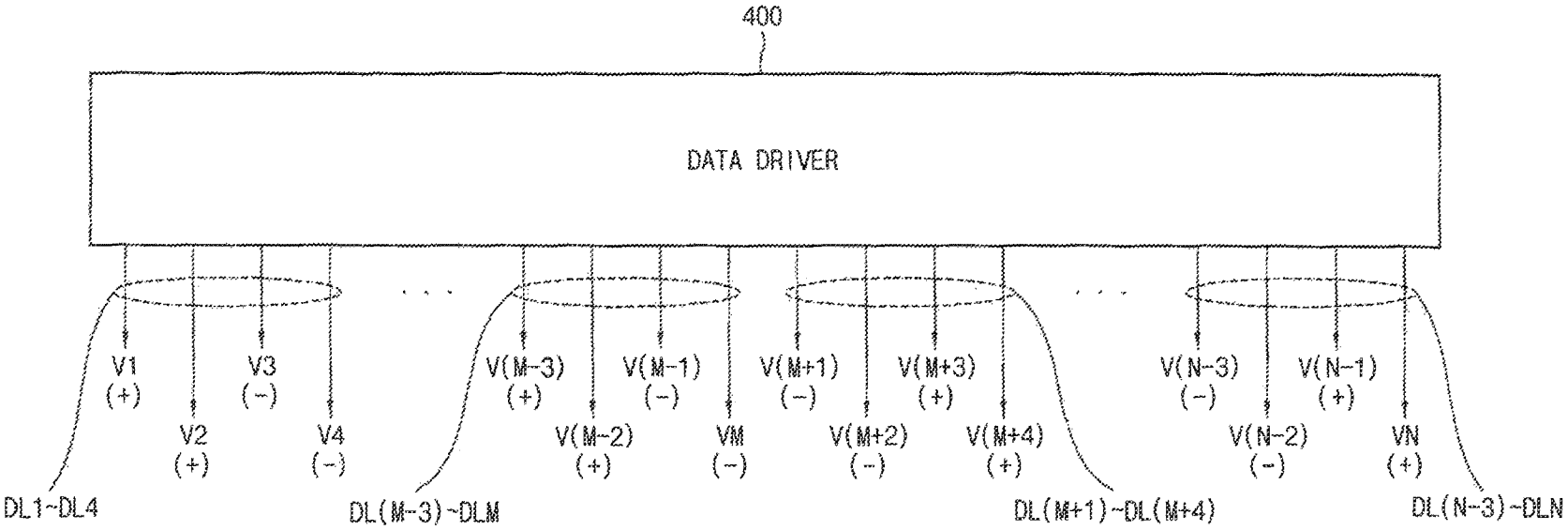

FIGS. 2A, 2C and 3A illustrate examples of a polarity pattern of the data voltages in the first operation mode. FIGS. 2B, 2D and 3B illustrate examples of a polarity pattern of the data voltages in the second operation mode.

Referring to FIGS. 1, 2A, 2B, 2C and 2D, the data driver 400 generates data voltages V1, V2, V3, V4, . . . , V(M−3), V(M−2), V(M−1), VM, V(M+1), V(M+2), V(M+3), V(M+4), . . . , V(N−3), V(N−2), V(N−1), VN based on the mode selection signal MS and the output image data DAT, and applies the data voltages V1~VN to data lines DL1~DL4, . . . , DL(M−3)~DLM, DL(M+1)~DL(M+4), . . . , DL(N−3)~DLN that are connected to the display panel 100. For example, the first through M-th data voltages V1~VM may be applied to the first through M-th data lines DL1~DLM, respectively, where M is a natural number. The (M+1)-th through N-th data voltages V(M+1)~VN may be applied to the (M+1)-th through N-th data lines DL(M+1)~DLN, respectively, where N is a natural number greater than M.

The display apparatus 10 operates in one of the first and second operation modes based on the mode selection signal MS. When a first image that is displayed based on the input image data IDAT does not include a predetermined pattern (e.g., a pattern causing or inducing crosstalk on the display panel 100), the display apparatus 10 may operate in the first operation mode. When the first image includes the predetermined pattern (e.g., a pattern causing or inducing crosstalk on the display panel 100), the display apparatus 10 may operate in the second operation mode. The first operation mode may be referred to as a normal mode, and the second operation mode may be referred to as a pattern detection function (PDF) mode.

When the display apparatus 10 operates in the first operation mode, during a first duration of the first operation mode, each of a polarity pattern of the first through M-th data voltages V1~VM and a polarity pattern of the (M+1)-th through N-th data voltages V(M+1)~VN includes a repetition of a first polarity pattern. In other words, in the first operation mode, polarities of the first through N-th data voltages V1~VN may comply with the same rule for all of the data lines DL1~DLN.

When the display apparatus 10 operates in the second operation mode, during a first duration of the second operation mode, the polarity pattern of the first through M-th data voltages V1~VM includes the repetition of the first polarity pattern, and the polarity pattern of the (M+1)-th through N-th data voltages V(M+1)~VN includes a repetition of a second polarity pattern that is different from the first polarity pattern. In other words, in the second operation mode, polarities of the first through N-th data voltages V1~VN may comply with different rules depending on locations of the data lines DL1~DLN.

In an exemplary embodiment of the present inventive concept, the first polarity pattern may include at least one first polarity and at least one second polarity that are arranged in a first order. The second polarity pattern may include the at least one first polarity and the at least one second polarity that are arranged in a second order reversed from the first order. The first polarity may be a positive polarity (+) with respect to a common voltage, and the second polarity may be a negative polarity (−) with respect to the common voltage.

For example, as illustrated in FIG. 2A, during the first duration of the first operation mode, each of the polarity pattern of the first through M-th data voltages V1~VM and the polarity pattern of the (M+1)-th through N-th data voltages V(M+1)~VN may be implemented by repeating a polarity pattern of "+, −". As illustrated in FIG. 2B, during the first duration of the second operation mode, the polarity pattern of the first through M-th data voltages V1~VM may be implemented by repeating the polarity pattern of "+, −", and the polarity pattern of the (M+1)-th through N-th data voltages V(M+1)~VN may be implemented by repeating a polarity pattern of "−, +". In other words, in the example of FIGS. 2A and 2B, the first polarity pattern may be "+, −", and the second polarity pattern may be "−, +".

In an exemplary embodiment of the present inventive concept, during a second duration of the first operation mode subsequent to the first duration of the first operation mode, each of the polarity pattern of the first through M-th data voltages V1~VM and the polarity pattern of the (M+1)-th through N-th data voltages V(M+1)~VN may include the repetition of the second polarity pattern. During a second duration of the second operation mode subsequent to the first duration of the second operation mode, the polarity pattern of the first through M-th data voltages V1~VM may include the repetition of the second polarity pattern, and the polarity pattern of the (M+1)-th through N-th data voltages V(M+1)~VN may include the repetition of the first polarity pattern.

For example, as illustrated in FIG. 2C, during the second duration of the first operation mode, each of the polarity pattern of the first through M-th data voltages V1~VM and the polarity pattern of the (M+1)-th through N-th data voltages V(M+1)~VN may be implemented by repeating the polarity pattern of "−, +". As illustrated in FIG. 2D, during the second duration of the second operation mode, the polarity pattern of the first through M-th data voltages V1~VM may be implemented by repeating the polarity pattern of "−, +", and the polarity pattern of the (M+1)-th through N-th data voltages V(M+1)~VN may be implemented by repeating the polarity pattern of "+, −".

In an exemplary embodiment of the present inventive concept, each duration may correspond to single horizontal line duration or single frame duration. The single horizontal line duration may correspond to an activation duration of a single gate line, and the single frame duration may correspond to a sum of activation durations of all of the gate lines. For example, the display panel 100 may include a plurality of horizontal lines each of which corresponds to a single pixel row, and each horizontal line in the display panel 100 may display one horizontal line image during one horizontal line duration. The display panel 100 may display one frame image based on a plurality of horizontal line images displayed on the plurality of horizontal lines during one frame duration.

In an exemplary embodiment of the present inventive concept, each of the first and second durations may correspond to one horizontal line duration and may be included in one frame duration. In other words, the polarity pattern of the first through N-th data voltages V1~VN may be changed (e.g., reversed) for each horizontal line. In an exemplary embodiment of the present inventive concept, each of the first and second durations may correspond to one frame duration. In other words, the polarity pattern of the first through N-th data voltages V1~VN may be changed (e.g., reversed) for each frame.

In the display apparatus 10 according to an exemplary embodiment of the present inventive concept, the data voltages V1~VN generated from the single data driver 400 may be divided into two groups. A first group of the data voltages V1~VM may have the polarity pattern that is maintained regardless of the operation mode, and a second group of the data voltages V(M+1)~VN may have the polarity pattern that is changed depending on the operation mode. The number M that corresponds to a boundary between the first and second groups may be set closest to a half of the number N that indicates the total number of the data voltages V1~VN.

Referring to FIGS. 1, 3A and 3B, the example of FIGS. 3A and 3B may be substantially the same as the example of FIGS. 2A and 2B, except that first and second polarity patterns in FIGS. 3A and 3B are different from the first and second polarity patterns in FIGS. 2A and 2B.

For example, during a first duration of the first operation mode illustrated in FIG. 3A, each of the polarity pattern of the first through M-th data voltages V1~VM and the polarity pattern of the (M+1)-th through N-th data voltages V(M+1)~VN may be implemented by repeating a polarity pattern of "+, +, −, −". During a first duration of the second operation mode illustrated in FIG. 3B, the polarity pattern of the first through M-th data voltages V1~VM may be implemented by repeating the polarity pattern of "+, +, −, −", and the polarity pattern of the (M+1)-th through N-th data voltages V(M+1)~VN may be implemented by repeating a polarity pattern of "−, −, +, +". In other words, in the example of FIGS. 3A and 3B, the first polarity pattern may be "+, +, −, −", and the second polarity pattern may be "−, −, +, +".

In an exemplary embodiment of the present inventive concept, during a second duration of the first operation mode subsequent to the first duration of the first operation mode, each of the polarity pattern of the first through M-th data voltages V1~VM and the polarity pattern of the (M+1)-th through N-th data voltages V(M+1)~VN may be implemented by repeating the polarity pattern of "−, −, +, +". During a second duration of the second operation mode subsequent to the first duration of the second operation mode, the polarity pattern of the first through M-th data voltages V1~VM may be implemented by repeating the polarity pattern of "−, −, +, +", and the polarity pattern of the (M+1)-th through N-th data voltages V(M+1)~VN may be implemented by repeating the polarity pattern of "+, +, −, −".

Although FIGS. 2A, 2B, 2C, 2D, 3A and 3B illustrate examples of the polarity pattern (e.g., the first polarity pattern) that is recursively arranged for the data voltages V1~VN and include the at least one first polarity (e.g., +) and the at least one second polarity (e.g., −), the number and an arrangement order of polarities in one polarity pattern may be changed. For example, the first polarity pattern may be "+, +, +, −, −, −", "−, +", "−, −, +, +", or "−, −, −, +, +, +", or the like.

In the display apparatus 10 according to an exemplary embodiment of the present inventive concept, the data driver 400 may internally and partially change the polarity pattern of the data voltages V1~VN in the second operation mode in which the predetermined pattern is detected in the first image, and thus, the polarities of the data voltages V1~VN may comply with different rules depending on the locations of the data lines DL1~DLN. Accordingly, crosstalk on the display panel 100 may be reduced, and deterioration of display quality may be prevented in the display apparatus 10.

Figure 4:
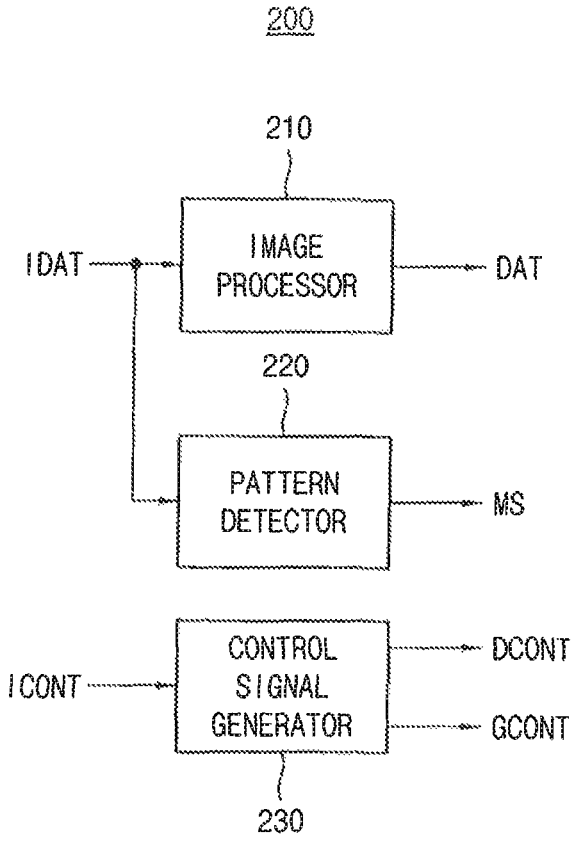
FIG. 4 is a block diagram illustrating a timing controller included in the display apparatus according to an exemplary embodiment of the present inventive concept.

FIG. 4 is a block diagram illustrating a timing controller included in the display apparatus according to an exemplary embodiment of the present inventive concept.

Referring to FIG. 4, a timing controller 200 may include an image processor 210, a pattern detector 220 and a control signal generator 230. The timing controller 200 is illustrated in FIG. 4 as being divided into three elements for convenience of explanation, however, the timing controller 200 may not be physically divided as shown.

The image processor 210 may generate the output image data DAT by performing at least one image processing on the input image data IDAT. For example, the image processor 210 may selectively perform an image quality compensation, a spot compensation, an adaptive color correction (ACC), and/or a dynamic capacitance compensation (DCC) on the input image data IDAT to generate the output image data DAT.

The pattern detector 220 may determine, based on the input image data IDAT, whether the first image displayed on the display panel 100 in FIG. 1 includes the predetermined pattern, and may generate the mode selection signal MS based on a result of the determination.

In an exemplary embodiment of the present inventive concept, when the first image does not include the predetermined pattern, the pattern detector may generate the mode selection signal MS that has a first logic level (e.g., a logic low level), and then, the display apparatus 10 of FIG. 1 may operate in the first operation mode based on the mode selection signal MS having the first logic level. When the first image includes the predetermined pattern, the pattern detector may generate the mode selection signal MS that has a second logic level (e.g., a logic high level) different from the first logic level, and then, the display apparatus 10 of FIG. 1 may operate in the second operation mode based on the mode selection signal MS having the second logic level.

The control signal generator 250 may generate the first control signal GCONT and the second control signal DCONT based on the input control signal ICONT.

Figure 5:
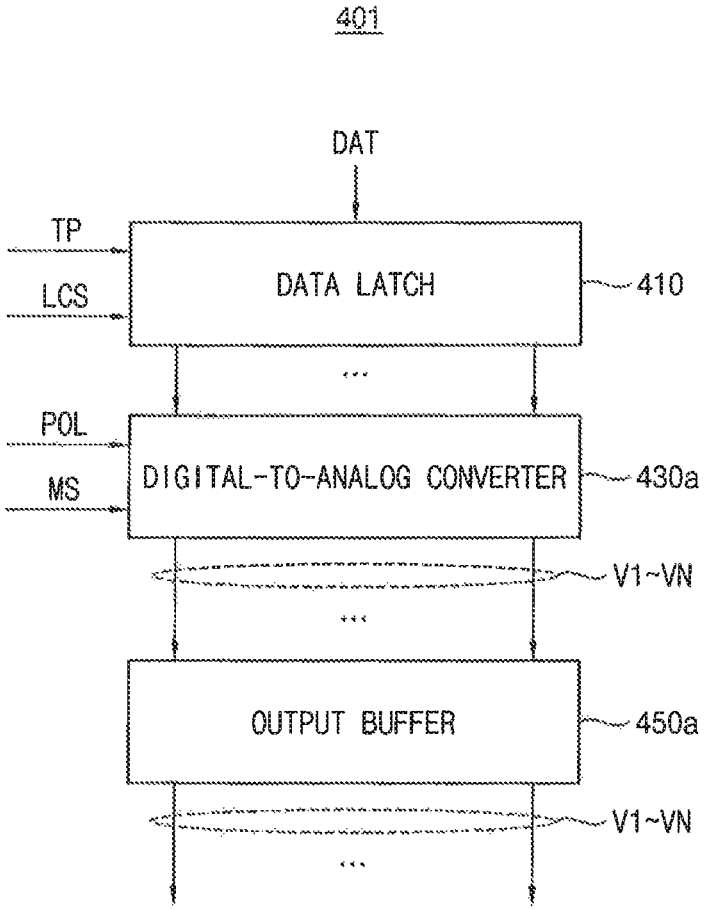
FIGS. 5 and 6 are block diagrams illustrating a data driver included in the display apparatus according to exemplary embodiments of the present inventive concept.
Figure 6:
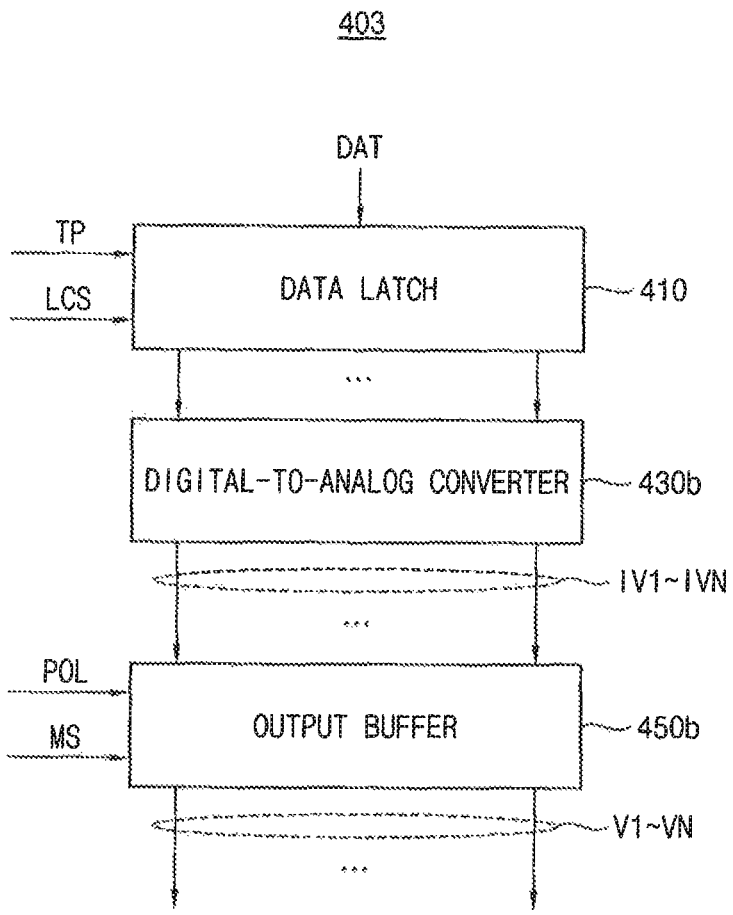

FIGS. 5 and 6 are block diagrams illustrating a data driver included in the display apparatus according to exemplary embodiments of the present inventive concept.

Referring to FIG. 5, a data driver 401 may include a data latch 410, a digital-to-analog converter 430*a* and an output buffer 450*a*.

The data latch 410 may sequentially store the output image data DAT (e.g., serial data) based on a latch control signal LCS, and may substantially simultaneously output the output image data DAT (e.g., parallel data) based on a data load signal TP. The latch control signal LCS and the data load signal TP may be included in the second control signal DCONT in FIG. 1. The data driver 401 may further include a shift register that generates the latch control signal LCS based on a horizontal start signal and a data clock signal included in the second control signal DCONT in FIG. 1.

The digital-to-analog converter 430*a* may generate the first through N-th data voltages V1~VN based on the output image data DAT, the mode selection signal MS and a polarity control signal POL. The digital-to-analog converter 430*a* may further receive grayscale compensation data to compensate the output image data DAT.

The first through N-th data voltages V1~VN may include data voltages that have levels higher than that of the common voltage (e.g., data voltages with the positive polarity), and data voltages that have levels lower than that of the common voltage (e.g., data voltages with the negative polarity). The first through N-th data voltages V1~VN from the digital-to-analog converter 430*a* may have a polarity pattern that is substantially the same as one of the examples of FIGS. 2A, 2B, 2C, 2D, 3A and 3B.

In an exemplary embodiment of the present inventive concept, the polarity control signal POL may be data of N bits. For example, when the display apparatus 10 of FIG. 1 operates in the first operation mode (e.g., when the mode selection signal MS has the first logic level), the polarity control signal POL may be N-bits of data such as "1010101010 . . . " in which bits of "10" are repeated N/2 times. In the first operation mode, each of odd-numbered data voltages that correspond to the bit of "1" in the polarity control signal POL may have the first polarity (e.g., the positive polarity), and each of even-numbered data voltages that correspond to the bit of "0" in the polarity control signal POL may have the second polarity (e.g., the negative polarity), as illustrated in FIG. 2A. When the display apparatus 10 of FIG. 1 operates in the second operation mode (e.g., when the mode selection signal MS has the second logic level), first through M-th bits of the polarity control signal POL that correspond to the first through M-th data voltages V1~VM may be maintained, and (M+1)-th through N-th bits of the polarity control signal POL that correspond to the (M+1)-th through N-th data voltages V(M+1)~VN may be inverted. In other words, in the second operation mode, the polarity control signal POL may be N-bits of data such as "1010 . . . 0101 . . . " in which bits of "10" are repeated N/4 times and bits of "01" are repeated N/4 times. In the second operation mode, the polarity pattern of the first through M-th data voltages V1~VM may be maintained, and the polarity pattern of the (M+1)-th through N-th data voltages V(M+1)~VN may be changed, as illustrated in FIG. 2B.

In an exemplary embodiment of the present inventive concept, the polarity control signal POL may be data of N bits in which polarity data of X bits is repeated N/X times, where X is a natural number equal to or greater than two. The first through N-th data voltages V1~VN may be generated in units of X based on the polarity control signal POL. For example, the polarity control signal POL may be generated by repeating 6-bits of polarity data such as "101010". When the display apparatus 10 of FIG. 1 operates in the first operation mode, the digital-to-analog converter 430*a* may sequentially generate the first through N-th data voltages V1~VN in units of six, e.g., first through sixth data voltages, seventh through twelfth data voltages, . . . , based on the polarity data of "101010" that is repeated N/6 times, and thus, the first through N-th data voltages V1~VN may have the polarity pattern, as illustrated in FIG. 2A. When the display apparatus 10 of FIG. 1 operates in the second operation mode, the digital-to-analog converter 430*a* may sequentially generate the first through M-th data voltages V1~VM in units of six based on the polarity data of "101010" that is repeated M/6 times and may sequentially generate the (M+1)-th through N-th data voltages V(M+1)~VN in units of six based on an inverted polarity data of "010101" that is repeated (N-M)/6 times, and thus, the first through N-th data voltages V1~VN may have the polarity pattern, as illustrated in FIG. 2B.

In an exemplary embodiment of the present inventive concept, M may be closest to a half of N. For example, if N is about 966, M may be about 483. In other words, when the data driver 401 is connected to about 966 data lines DL, first through 483rd data voltages applied to first through 483rd data lines DL may form a first group that has a polarity pattern maintained regardless of the operation mode, and 484th through 966th data voltages applied to 484th through 966th data lines DL may form a second group that has a polarity pattern that changes depending on the operation mode.

In an exemplary embodiment of the present inventive concept, when the first through N-th data voltages V1~VN are generated in units of X based on the polarity control signal POL, M may be one of multiples of X and may be closest to a half of N. For example, if N is about 966, M may be about 480 (or about 486). In other words, when the data driver 401 is connected to about 966 data lines DL, first through 480th data voltages applied to first through 480th data lines DL may form a first group that has a polarity pattern maintained regardless of the operation mode, and 481st through 966th data voltages applied to 481st through 966th data lines DL may form a second group that has a polarity pattern that changes depending on the operation mode.

The output buffer 450*a* may output the first through N-th data voltages V1~VN to the first through N-th data lines DL1~DLN. The display panel 100 in FIG. 1 may receive the data voltages V1~VN and may operate (e.g., display an image) based on the data voltages V1~VN.

Referring to FIG. 6, a data driver 403 may include a data latch 410, a digital-to-analog converter 430*b* and an output buffer 450*b*. The data latch 410 in FIG. 6 may be substantially the same as the data latch 410 in FIG. 5.

The digital-to-analog converter 430*b* may generate first through N-th voltage values IV1~IVN based on the output image data DAT. The first through N-th voltage values IV1~IVN may correspond to the first through N-th data voltages V1~VN, respectively. For example, the first voltage value IV1 may represent a difference between the first data voltage V1 and the common voltage.

The output buffer 450*b* may output the first through N-th data voltages V1~VN to the first through N-th data lines DL1~DLN based on the first through N-th voltage values IV1~IVN, the mode selection signal MS and the polarity control signal POL.

The first through N-th data voltages V1~VN may include the data voltages with the positive polarity and the data voltages with the negative polarity. The first through N-th data voltages V1~VN output from the output buffer 450*b* may have a polarity pattern that is substantially the same as one of the examples of FIGS. 2A, 2B, 2C, 2D, 3A and 3B.

Figure 7:
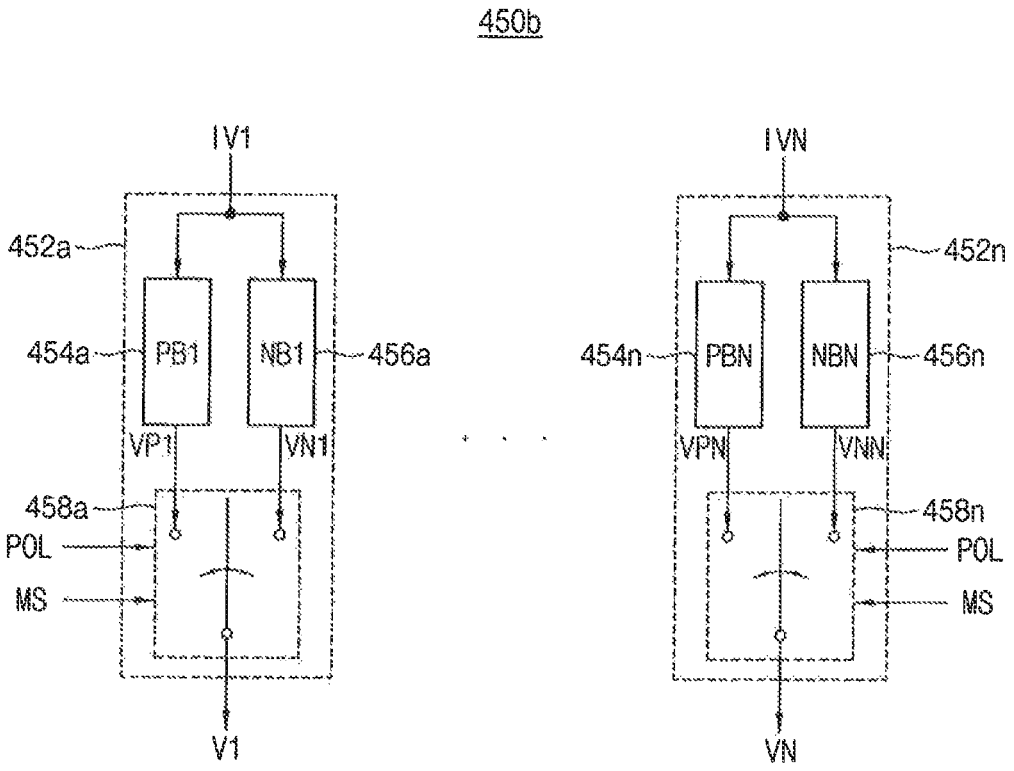
FIG. 7 is a block diagram illustrating an output buffer included in the data driver of FIG. 6 according to an exemplary embodiment of the present inventive concept.

FIG. 7 is a block diagram illustrating an output buffer included in the data driver of FIG. 6 according to an exemplary embodiment of the present inventive concept.

Referring to FIG. 7, the output buffer 450*b* may include first through N-th buffers 452*a*~452*n* that generate the first through N-th data voltages V1~VN, respectively.

The first buffer 452*a* may include a first buffer unit 454*a*, a second buffer unit 456*a* and a first switch unit 458*a*. The first buffer unit 454*a* may generate a first internal data voltage VP1 having the first polarity (e.g., the positive polarity) based on the first voltage value IV1. The second buffer unit 456*a* may generate a second internal data voltage VN1 having the second polarity (e.g., the negative polarity) based on the first voltage value IV1. The first switch unit 458*a* may output one of the first and second internal data voltages VP1 and VN1 as the first data voltage V1 based on the mode selection signal MS and the polarity control signal POL.

Each of the buffers of the output buffer 450*b* may have a configuration substantially the same as that of the first buffer 452*a*. For example, the N-th buffer 452*n* may include a (2N−1)-th buffer unit 454*n*, a 2N-th buffer unit 456*n* and a N-th switch unit 458*n*. The (2N−1)-th buffer unit 454*n* may generate a (2N−1)-th internal data voltage VPN having the first polarity based on the N-th voltage value IVN. The 2N-th buffer unit 456*n* may generate a 2N-th internal data voltage VNN having the second polarity based on the N-th voltage value IVN. The N-th switch unit 458*n* may output one of the (2N−1)-th and 2N-th internal data voltages VPN and VNN as the N-th data voltage VN based on the mode selection signal MS and the polarity control signal POL.

As described above with reference to FIG. 5, according to an exemplary embodiment of the present inventive concept, the polarity control signal POL may be data of N bits or may be implemented by repeating the polarity data of X bits. According to an exemplary embodiment of the present inventive concept, M may be closest to a half of N, or M may be one of multiples of X and may be closest to a half of N.

Figure 8:
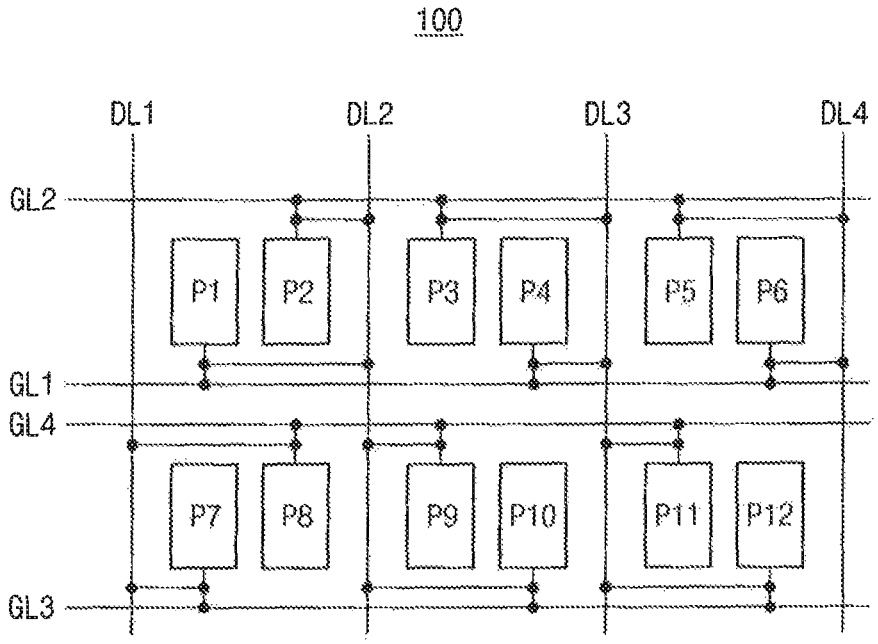
FIG. 8 is a diagram illustrating a display panel included in the display apparatus according to an exemplary embodiment of the present inventive concept.

FIG. 8 is a diagram illustrating a display panel included in the display apparatus according to an exemplary embodiment of the present inventive concept.

Referring to FIG. 8, a display panel 100 may include a plurality of pixels P1, P2, P3, P4, P5, P6, P7, P8, P9, P10, P11 and P12.

Each of the plurality of pixels P1~P12 may be connected to one gate line GL and one data line DL. In the example of FIG. 8, two adjacent pixels in the same pixel row may be connected to the same data line DL, and the display panel 100 may have a structure where data lines DL are connected to pixels based on an alternating scheme. The alternating scheme may be a scheme in which a particular data line DL is connected to pixels disposed at both sides (e.g., both left and right sides) thereof.

For example, in a first pixel row, the pixel P1 may be connected to a data line DL2 and a gate line GL1. The pixel P2 adjacent to the pixel P1 may be connected to the data line DL2 and a gate line GL2. The pixel P3 adjacent to the pixel P2 may be connected to a data line DL3 and the gate line GL2. The pixel P4 adjacent to the pixel P3 may be connected to the data line DL3 and the gate line GL1. The pixel P5 adjacent to the pixel P4 may be connected to a data line DL4 and the gate line GL2. The pixel P6 adjacent to the pixel P5 may be connected to the data line DL4 and the gate line GL1.

In a second pixel row adjacent to the first pixel row, the pixel P7 adjacent to the pixel P1 may be connected to a data line DL1 and a gate line GL3. The pixel P8 adjacent to the pixels P2 and P7 may be connected to the data line DL1 and a gate line GL4. The pixel P9 adjacent to the pixels P3 and P8 may be connected to the data line DL2 and the gate line GL4. The pixel P10 adjacent to the pixels P4 and P9 may be connected to the data line DL2 and the gate line GL3. The pixel P11 adjacent to the pixels P5 and P10 may be connected to the data line DL3 and the gate line GL4. The pixel P12 adjacent to the pixels P6 and P11 may be connected to the data line DL3 and the gate line GL3.

In an exemplary embodiment of the present inventive concept, the plurality of pixels P1~P12 may include red pixels for outputting red light, green pixels for outputting green light, and blue pixels for outputting blue light. For example, the pixels P1, P4, P7 and P10 may be the red pixels, the pixels P2, P5, P8 and P11 may be the green pixels, and the pixels P3, P6, P9 and P12 may be the blue pixels.

In an exemplary embodiment of the present inventive concept, the plurality of pixels P1~P12 may include red pixels for outputting red light, green pixels for outputting green light, blue pixels for outputting blue light, and white pixels for outputting white light. For example, the pixels P1, P5 and P9 may be the red pixels, the pixels P2, P6 and P10 may be the green pixels, the pixels P3, P7 and P11 may be the blue pixels, and the pixels P4, P8 and P12 may be the white pixels.

Figure 9:
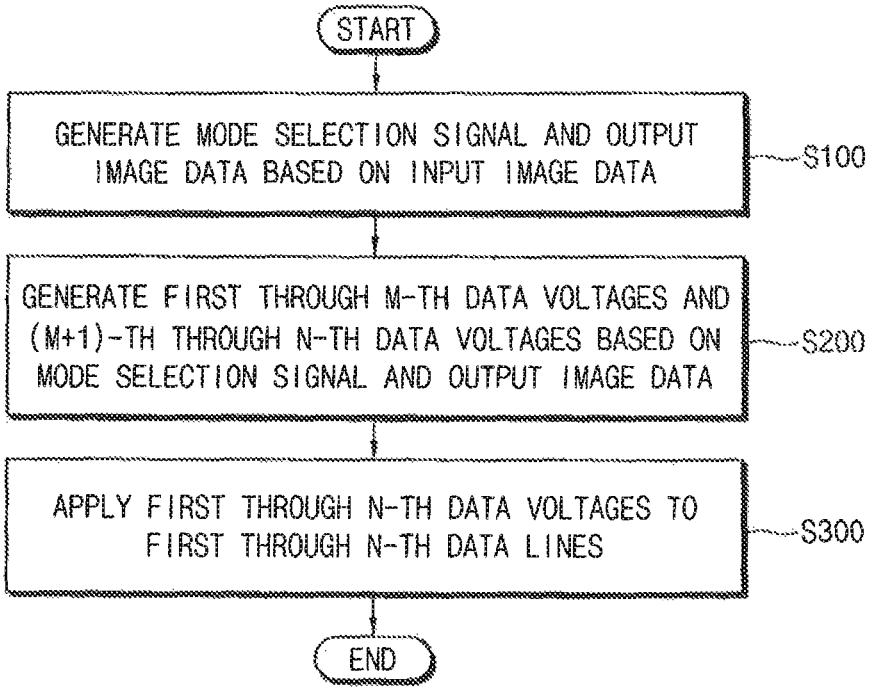
FIG. 9 is a flow chart illustrating a method of operating a display apparatus according to an exemplary embodiment of the present inventive concept.

FIG. 9 is a flow chart illustrating a method of operating a display apparatus according to an exemplary embodiment of the present inventive concept.

Referring to FIGS. 1 and 9, in the method of operating the display apparatus 10 according to an exemplary embodiment of the present inventive concept, the timing controller 200 generates the mode selection signal MS and the output image data DAT based on the input image data IDAT (S100). The mode selection signal MS represents one of the first operation mode and the second operation mode. The data driver 400 generates the first through M-th data voltages V1~VM and the (M+1)-th through N-th data voltages V(M+1)~VN based on the mode selection signal MS and the output image data DAT (S200), and applies the first through N-th data voltages V1~VN to the first through N-th data lines DL1~DLN connected to the display panel 100, respectively (S300).

During the first duration of the first operation mode, each of the polarity pattern of the first through M-th data voltages V1~VM and the polarity pattern of the (M+1)-th through N-th data voltages V(M+1)~VN includes the repetition of the first polarity pattern. For example, the first polarity pattern may be "+, −" as illustrated in FIG. 2A, or "+, +, −, −" as illustrated in FIG. 3A.

During the first duration of the second operation mode, the polarity pattern of the first through M-th data voltages V1~VM includes the repetition of the first polarity pattern, and the polarity pattern of the (M+1)-th through N-th data voltages V(M+1)~VN includes the repetition of the second polarity pattern. For example, the second polarity pattern may be "−, +" as illustrated in FIG. 2B, or "−, −, +, +" as illustrated in FIG. 3B.

As described above with reference to FIGS. 5 and 7, M may be closest to a half of N, or M may be one of multiples of X and may be closest to a half of N, where X represents the bit number of the polarity data repeated in the polarity control signal POL.

Figure 10:
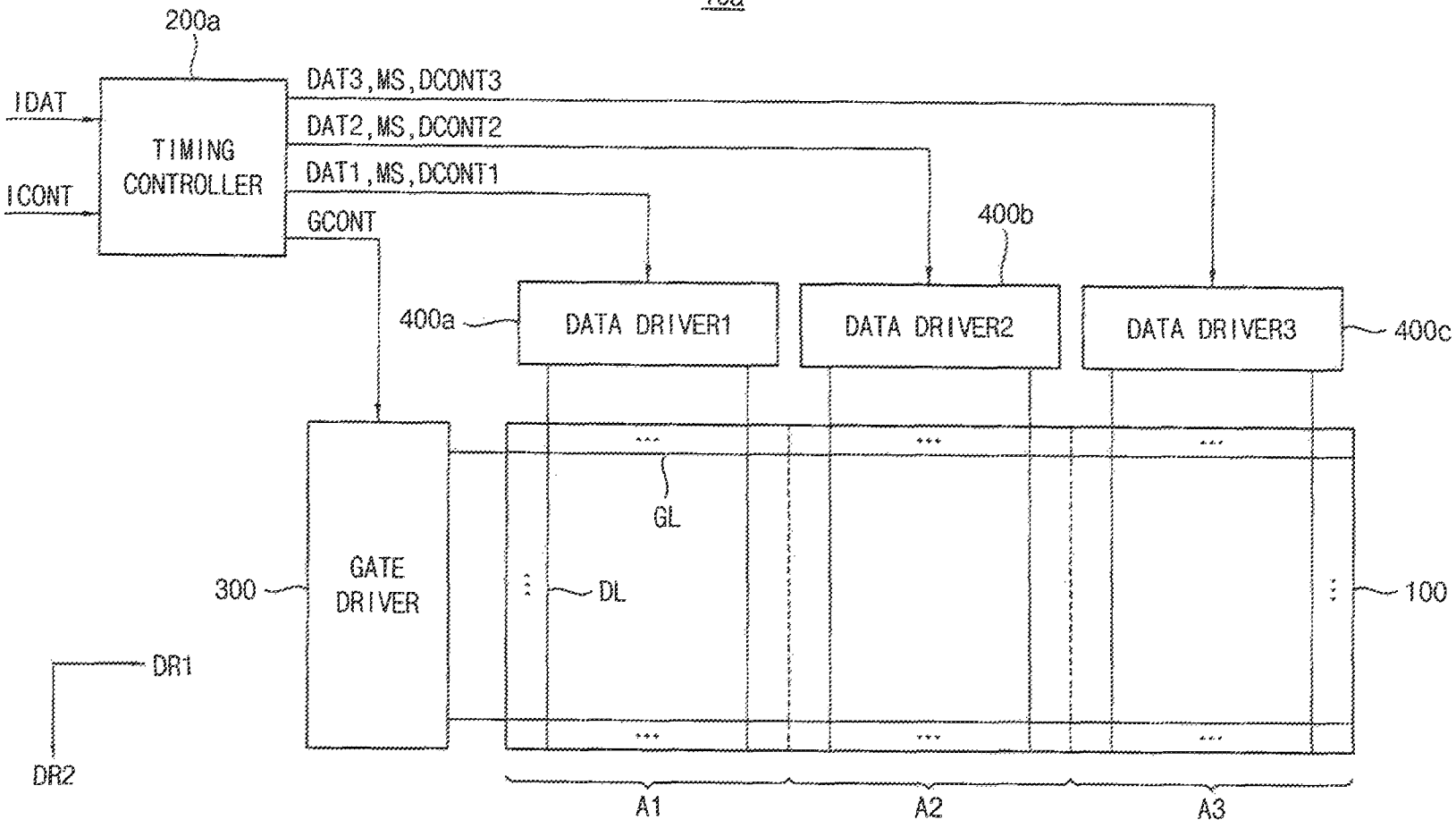
FIG. 10 is a block diagram illustrating a display apparatus according to an exemplary embodiment of the present inventive concept.

FIG. 10 is a block diagram illustrating a display apparatus according to an exemplary embodiment of the present inventive concept.

Referring to FIG. 10, a display apparatus 10*a* includes a display panel 100, a timing controller 200*a*, a gate driver 300, a first data driver 400*a*, a second data driver 400*b* and a third data driver 400*c*.

The display apparatus 10*a* of FIG. 10 may be substantially the same as the display apparatus 10 of FIG. 1, except that the display apparatus 10*a* includes a plurality of (e.g., an odd number of) data drivers 400*a*, 400*b* and 400*c* and an operation of the timing controller 200*a* is partially changed.

The display panel 100 operates (e.g., displays an image) based on first, second and third output image data DAT1, DAT2 and DAT3. The display panel 100 may be divided into three display regions A1, A2 and A3 based on the number of the data drivers 400*a*, 400*b* and 400*c*.

The timing controller 200*a* generates the first, second and third output image data DAT1, DAT2 and DAT3 and a mode selection signal MS based on the input image data IDAT. The first, second and third output image data DAT1, DAT2 and DAT3 may correspond to the first, second and third display regions A1, A2 and A3, respectively. The timing controller 200*a* generates the first control signal GCONT for the gate driver 300 and second, third and fourth control signals DCONT1, DCONT2 and DCONT3 for the first, second and third data drivers 400*a*, 400*b* and 400*c* based on the input control signal ICONT.

The gate driver 300 generates the gate signals based on the first control signal GCONT and provides the gate signals to the gate lines GL.

The data drivers 400*a*, 400*b* and 400*c* generate the data voltages based on the output image data DAT1, DAT2 and DAT3, the control signals DCONT1, DCONT2 and DCONT3 and the mode selection signal MS and provide the data voltages to the data lines DL. Each of the data drivers 400*a*, 400*b* and 400*c* in FIG. 10 may be similar to the data driver 400 in FIG. 1 and may have a configuration similar to that of the data driver 401 and 403 described with reference to FIGS. 5, 6 and 7.

Figure 11A:
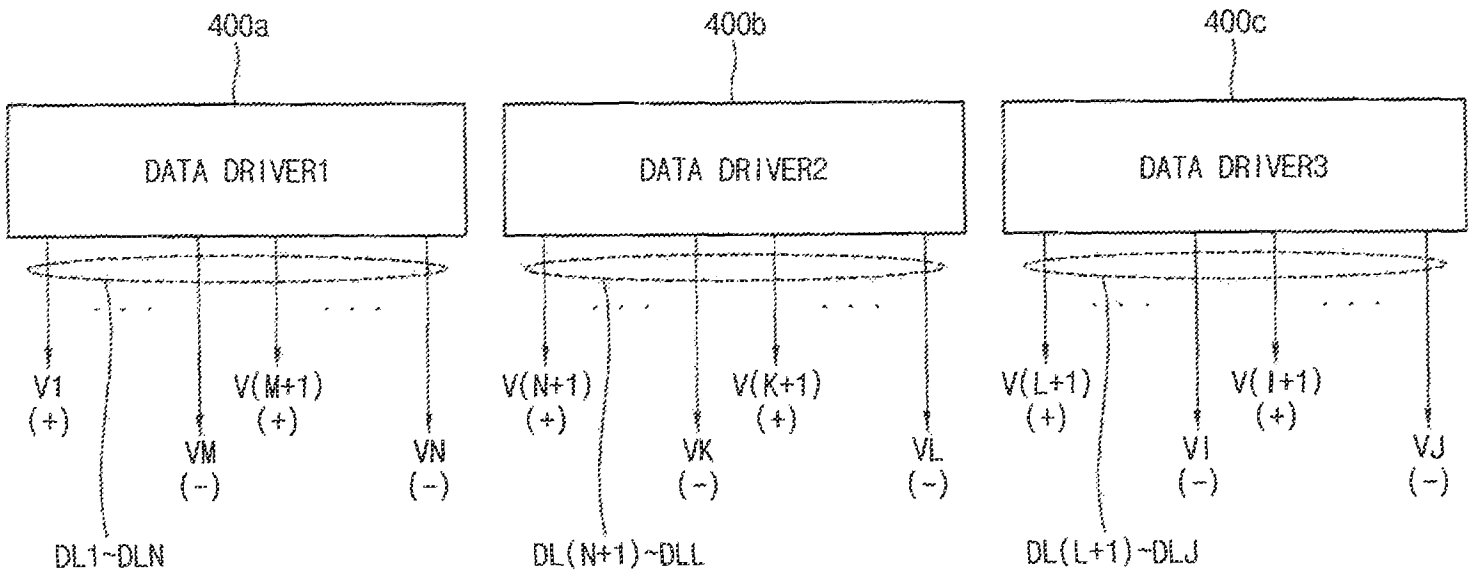
FIGS. 11A and 11B are diagrams for describing an operation of the display apparatus according to exemplary embodiments of the present inventive concept.
Figure 11B:
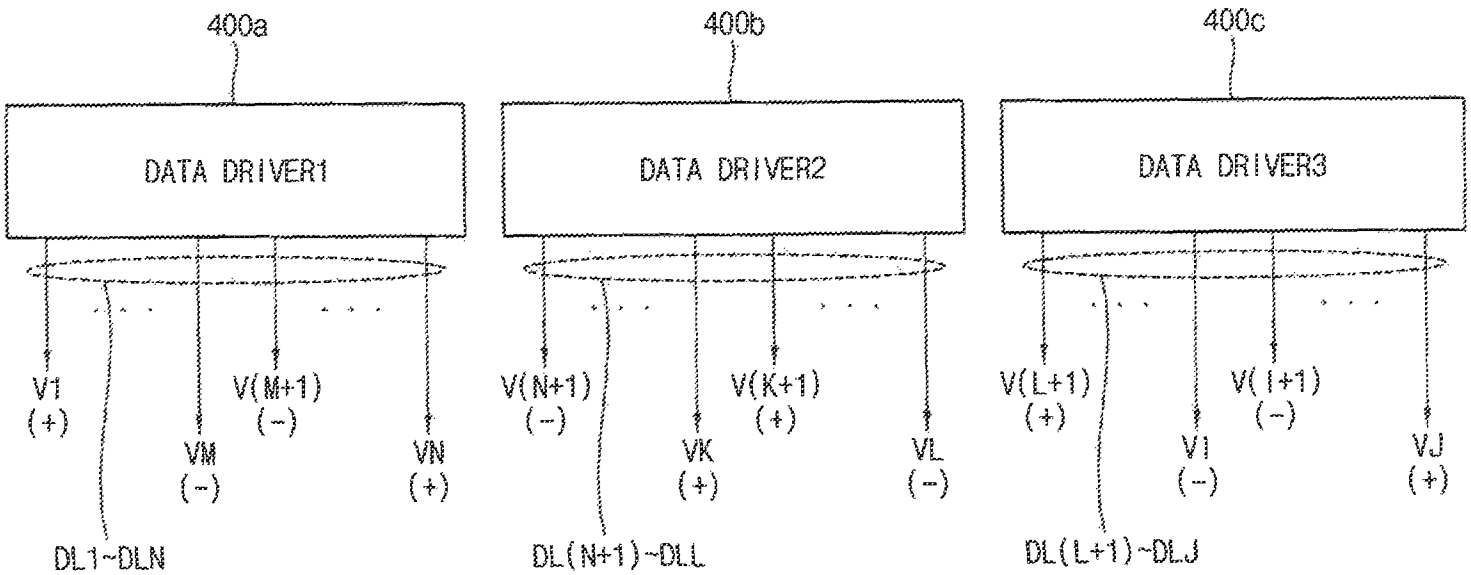

FIGS. 11A and 11B are diagrams for describing an operation of the display apparatus according to exemplary embodiments of the present inventive concept.

FIG. 11A illustrates an example of a polarity pattern of the data voltages in the first operation mode. FIG. 11B illustrates an example of a polarity pattern of the data voltages in the second operation mode.

Referring to FIGS. 10, 11A and 11B, the first data driver 400*a* generates the first through M-th data voltages V1~VM and the (M+1)-th through N-th data voltages V(M+1)~VN based on the mode selection signal MS and the first output image data DAT1, and applies the data voltages V1~VN to the data lines DL1~DLN that are connected to the display panel 100.

The second data driver 400*b* generates (N+1)-th through K-th data voltages V(N+1)~VK and (K+1)-th through L-th data voltages V(K+1)~VL based on the mode selection signal MS and the second output image data DAT2, where K is a natural number greater than N and L is a natural number greater than K. The third data driver 400*c* generates (L+1)-th through I-th data voltages V(L+1)~VI and (I+1)-th through J-th data voltages V(I+1)~VJ based on the mode selection signal MS and the third output image data DAT3, where I is a natural number greater than L and J is a natural number greater than I. The second data driver 400*b* applies the data voltages V(N+1)~VL to data lines DL(N+1)~DLL that are connected to the display panel 100, and the third data driver 400*c* applies the data voltages V(L+1)~VJ to data lines DL(L+1)~DLJ that are connected to the display panel 100.

The display apparatus 10*a* may operate in the first operation mode based on the mode selection signal MS. As illustrated in FIG. 11A, during a first duration of the first operation mode, each of a polarity pattern of the first through M-th data voltages V1~VM, a polarity pattern of the (M+1)-th through N-th data voltages V(M+1)~VN, a polarity pattern of the (N+1)-th through K-th data voltages V(N+1)~VK, a polarity pattern of the (K+1)-th through L-th data voltages V(K+1)~VL, a polarity pattern of the (L+1)-th through I-th data voltages V(L+1)~VI and a polarity pattern of the (I+1)-th through J-th data voltages V(I+1)~VJ may include a repetition of a first polarity pattern. For example, the first polarity pattern may include at least one first polarity (e.g., positive polarity) and at least one second polarity (e.g., negative polarity) that are arranged in a first order, and may be, e.g., "+, −", "+, +, −, −", etc.

The display apparatus 10*a* may operate in the second operation mode based on the mode selection signal MS. As illustrated in FIG. 11B, during a first duration of the second operation mode, each of the polarity pattern of the first through M-th data voltages V1~VM, the polarity pattern of the (K+1)-th through L-th data voltages V(K+1)~VL and the polarity pattern of the (L+1)-th through I-th data voltages V(L+1)~VI may include the repetition of the first polarity pattern, and each of the polarity pattern of the (M+1)-th through N-th data voltages V(M+1)~VN, the polarity pattern of the (N+1)-th through K-th data voltages V(N+1)~VK and the polarity pattern of the (I+1)-th through J-th data voltages V(I−1)~VJ may include a repetition of a second polarity pattern. For example, the second polarity pattern may include the at least one first polarity and the at least one second polarity that are arranged in a second order reversed from the first order, and may be, e.g., "−, +", "−, −, +, +", etc.

As described above, in the first operation mode, polarities of the data voltages V1~VJ may comply with the same rule for all of the data lines DL1~DLJ. In the second operation mode, polarities of the first through N-th data voltages V1~VJ may comply with different rules depending on locations of the data lines DL1~DLJ and the data drivers 400*a*-400*c*. For example, in the second operation mode, the data voltages (e.g., V1~VN) generated by the single data driver (e.g., 400*a*) may be divided into two groups (e.g., V1~VM and V(M+1)~VN), and then, the data voltages may be controlled such that the polarity pattern of one group of the data voltages (e.g., V(M+1)~VN) is different from the polarity pattern of the other group of the data voltages (e.g., V1~VM). In addition, in the second operation mode, the polarity pattern of the data voltages V(N+1)~VL generated by the data driver 400*b* (e.g., an even-numbered data driver) may be controlled to be different from the polarity pattern of the data voltages V1~VN generated by the data driver 400*a* (e.g., an odd-numbered data driver).

According to an exemplary embodiment of the present inventive concept, each duration may correspond to a single horizontal line duration or a single frame duration. The polarity pattern of the data voltages V1~VJ may be changed (e.g., reversed) for each horizontal line or for each frame.

In the display apparatus 10*a* according to an exemplary embodiment of the present inventive concept, the data drivers 400*a*-400*c* may internally and partially change the polarity pattern of the data voltages V1~VJ in the second operation mode in which the predetermined pattern is detected, and thus, the polarities of the data voltages V1~VJ may comply with different rules depending on the locations of the data lines DL1~DLJ. In addition, when the display apparatus 10*a* includes the plurality of data drivers 400*a*-400*c*, the polarities of the data voltages V1~VJ may comply with different rules depending on the locations of the data drivers 400*a*-400*c*. Accordingly, crosstalk on the display panel 100 can be reduced, and deterioration of display quality can be prevented in the display apparatus 10*a*.

Figure 12:
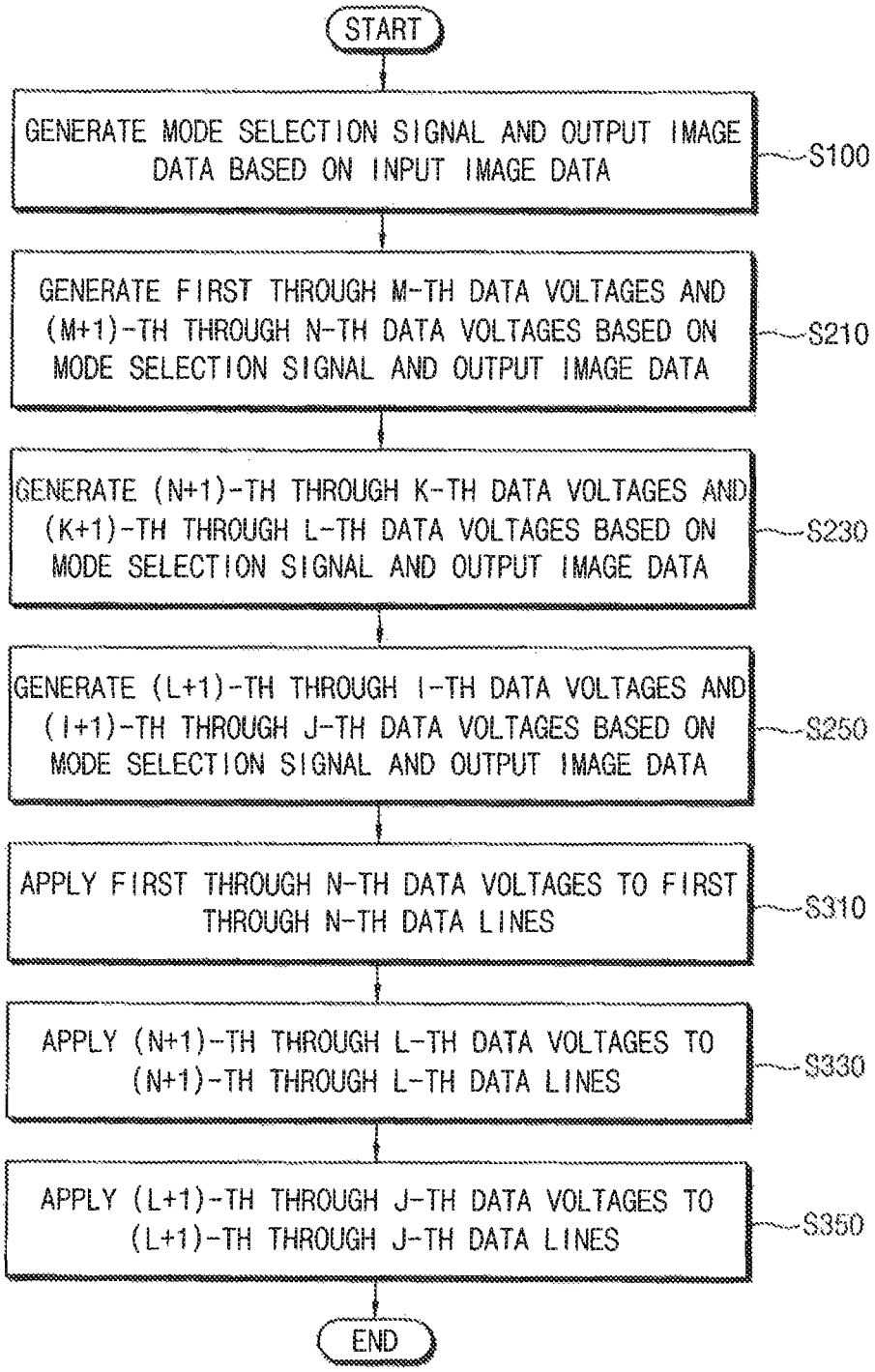
FIG. 12 is a flow chart illustrating a method of operating a display apparatus according to an exemplary embodiment of the present inventive concept.

FIG. 12 is a flow chart illustrating a method of operating a display apparatus according to an exemplary embodiment of the present inventive concept.

Referring to FIGS. 10 and 12, in the method of operating the display apparatus 10*a* according to an exemplary embodiment of the inventive concept, the timing controller 200*a* generates the mode selection signal MS and the output image data DAT1, DAT2 and DAT3 based on the input image data IDAT (S100). The data drivers 400*a*, 400*b* and 400*c* generate the first through M-th data voltages V1~VM, the (M+1)-th through N-th data voltages V(M+1)~VN, the (N+1)-th through K-th data voltages V(N+1)~VK, the (K+1)-th through L-th data voltages V(K+1)~VL, the (L+1)-th through I-th data voltages V(L+1)~VI and the (I+1)-th through J-th data voltages V(I+1)~VJ based on the mode selection signal MS and the output image data DAT1, DAT2 and DAT3 (S210, S230 and S250). The data drivers 400*a*, 400*b* and 400*c* apply the data voltages V1~VN, the data voltages V(N+1)~VL and the data voltages V(L+1)~VJ to the data lines DL1~DLN, the data lines DL(N+1)~DLL and the data lines DL(L+1)~DLJ, respectively (S310, S330 and S350).

During the first duration of the first operation mode, each of the polarity pattern of the first through M-th data voltages V1~VM, the polarity pattern of the (M+1)-th through N-th data voltages V(M+1)~VN, the polarity pattern of the (N+1)-th through K-th data voltages V(N+1)~VK, the polarity pattern of the (K+1)-th through L-th data voltages V(K+1)~VL, the polarity pattern of the (L+1)-th through I-th data voltages V(L+1)~VI and the polarity pattern of the (I+1)-th through J-th data voltages V(I+1)~VJ includes the repetition of the first polarity pattern.

During the first duration of the second operation mode, each of the polarity pattern of the first through M-th data voltages V1~VM, the polarity pattern of the (K+1)-th through L-th data voltages V(K+1)~VL and the polarity pattern of the (L+1)-th through I-th data voltages V(L+1)~VI includes the repetition of the first polarity pattern, and each of the polarity pattern of the (M+1)-th through N-th data voltages V(M+1)~VN, the polarity pattern of the (N+1)-th through K-th data voltages V(N+1)~VK and the polarity pattern of the (I+1)-th through J-th data voltages V(I+1)~VJ includes the repetition of the second polarity pattern.

S210, S230 and S250 may be substantially simultaneously or concurrently performed, and S310, S330 and S350 may be substantially simultaneously or concurrently performed. Each of S210, S230 and S250 may be similar to S200 in FIG. 9, and each of S310, S330 and S350 may be similar to S300 in FIG. 9.

Although the exemplary embodiments of the present inventive concept are described based on examples where the display apparatus includes a specific number of data lines, a specific number of data drivers and a display panel having a specific structure, the exemplary embodiments of the present inventive concept can be employed by a display apparatus that includes any number of data lines, any number of data drivers and any structure of a display panel.

The above described exemplary embodiments of the present inventive concept may be used in a display apparatus and/or a system including the display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, a smart card, a printer, etc.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A display apparatus, comprising:

a timing controller configured to generate a mode selection signal and output image data in response to input image data, the mode selection signal indicating a first operation mode or a second operation mode;

a first data driver configured to generate first through M-th data voltages and (M+1)-th through N-th data voltages in response to the mode selection signal and the output image data, and to apply the first through N-th data voltages to first through N-th data lines, respectively, where M is a natural number and N is a natural number greater than M; and a display panel connected to the first through N-th data lines, wherein, during a first duration of the first operation mode, each of a polarity pattern of the first through M-th data voltages and a polarity pattern of the (M+1)-th through N-th data voltages repeats a first polarity pattern, wherein, during a first duration of the second operation mode, the polarity pattern of the first through M-th data voltages repeats the first polarity pattern, and the polarity pattern of the (M+1)-th through N-th data voltages repeats a second polarity pattern different from the first polarity pattern, wherein the first data driver includes:

a digital-to-analog converter configured to generate the first through N-th data voltages in response to the mode selection signal, a polarity control signal and the output image data, wherein the mode selection signal and the polarity control signal are directly provided to the digital-to-analog converter; and an output buffer configured to output the first through N-th data voltages to the first through N-th data lines.

2. The display apparatus of claim 1, wherein the first polarity pattern includes at least one first polarity and at least one second polarity that are arranged in a first order, wherein the second polarity pattern includes the at least one first polarity and the at least one second polarity that are arranged in a second order different from the first order.

3. The display apparatus of claim 2, wherein the first polarity is a positive polarity with respect to a common voltage, and the second polarity is a negative polarity with respect to the common voltage.

4. The display apparatus of claim 1, wherein, during a second duration of the first operation mode subsequent to the first duration of the first operation mode, each of the polarity pattern of the first through M-th data voltages and the polarity pattern of the (M+1)-th through N-th data voltages repeats the second polarity pattern, wherein, during a second duration of the second operation mode subsequent to the first duration of the second operation mode, the polarity pattern of the first through M-th data voltages repeats the second polarity pattern, and the polarity pattern of the (M+1)-th through N-th data voltages repeats the first polarity pattern.

5. The display apparatus of claim 1, wherein M is about a half of N.

6. The display apparatus of claim 5, wherein the first through N-th data voltages are generated in units of X in response to the polarity control signal, where X is a natural number equal to or greater than two, wherein M is a multiple of X and is about a half of N.

7. The display apparatus of claim 1, further comprising:

a second data driver configured to generate (N+1)-th through K-th data voltages and (K+1)-th through L-th data voltages in response to the mode selection signal and the output image data, and to apply the (N+1)-th through L-th data voltages to (N+1)-th through L-th data lines, respectively, where K is a natural number greater than N and L is a natural number greater than K; and a third data driver configured to generate (L+1)-th through I-th data voltages and (I+1)-th through J-th data voltages in response to the mode selection signal and the output image data, and to apply the (L+1)-th through J-th data voltages to (L+1)-th through J-th data lines, respectively, where I is a natural number greater than L and J is a natural number greater than I, wherein the display panel is connected to the (N+1)-th through L-th data lines and the (L+1)-th through J-th data lines.

8. The display apparatus of claim 7, wherein, during the first duration of the second operation mode, a polarity pattern of the (N+1)-th through K-th data voltages repeats the second polarity pattern, and a polarity pattern of the (K+1)-th through L-th data voltages repeats the first polarity pattern.

9. The display apparatus of claim 8, wherein, during the first duration of the second operation mode, a polarity pattern of the (L+1)-th through I-th data voltages repeats the first polarity pattern, and a polarity pattern of the (I+1)-th through J-th data voltages repeats the second polarity pattern.

10. The display apparatus of claim 1, wherein the display panel includes:

a first pixel connected to the first data line and a first gate line; and a second pixel adjacent to the first pixel, the second pixel connected to the first data line and a second gate line adjacent to the first gate line.

11. The display apparatus of claim 1, wherein the display apparatus operates in the second operation mode when a first image displayed in response to the input image data includes a predetermined pattern, wherein the display apparatus operates in the first operation mode when the first image does not include the predetermined pattern.

12. A method of operating a display apparatus including a display panel, the method comprising:

generating a mode selection signal and output image data in response to input image data, the mode selection signal identifying a first operation mode or a second operation mode;

generating first through M-th data voltages and (M+1)-th through N-th data voltages in response to the mode selection signal and the output image data, where M is a natural number and N is a natural number greater than M, wherein the first through N-th data voltages are generated by applying the mode selection signal directly to a digital-to-analog converter; and applying the first through N-th data voltages to first through N-th data lines connected to the display panel, respectively, wherein, during a first duration of the first operation mode, each of a polarity pattern of the first through M-th data voltages and a polarity pattern of the (M+1)-th through N-th data voltages repeats a first polarity pattern, wherein, during a first duration of the second operation mode, the polarity pattern of the first through M-th data voltages repeats the first polarity pattern, and the polarity pattern of the (M+1)-th through N-th data voltages repeats a second polarity pattern different from the first polarity pattern.

13. The method of claim 12, wherein the first polarity pattern includes at least one first polarity and at least one second polarity that are arranged in a first order, wherein the second polarity pattern includes the at least one first polarity and the at least one second polarity that are arranged in a second order different from the first order.

14. The method of claim 12, further comprising:

generating (N+1)-th through K-th data voltages and (K+1)-th through L-th data voltages in response to the mode selection signal and the output image data, where K is a natural number greater than N and L is a natural number greater than K;

generating (L+1)-th through I-th data voltages and (I+1)-th through J-th data voltages in response to the mode selection signal and the output image data, where I is a natural number greater than L and J is a natural number greater than I;

applying the (N+1)-th through L-th data voltages to (N+1)-th through L-th data lines connected to the display panel, respectively; and applying the (L+1)-th through J-th data voltages to (L+1)-th through J-th data lines connected to the display panel, respectively.

15. The method of claim 14, wherein, during the first duration of the second operation mode, a polarity pattern of the (N+1)-th through K-th data voltages repeats the second polarity pattern, a polarity pattern of the (K+1)-th through L-th data voltages repeats the first polarity pattern, a polarity pattern of the (L+1)-th through I-th data voltages repeats the first polarity pattern, and a polarity pattern of the (I+1)-th through J-th data voltages repeats the second polarity pattern.

16. A method of operating a display apparatus including a display panel, the method comprising:

generating a first group of data voltages having a first polarity pattern in a first operation mode and a second group of data voltages having the first polarity pattern in the first operation mode, wherein the first and second groups of data voltages are generated by applying a mode selection signal having a first level directly to a first digital-to-analog converter;

applying the first group of data voltages to a first group of data lines of the display panel and applying the second group of data voltages to a second group of data lines of the display panel;

generating a third group of data voltages having the first polarity pattern in a second operation mode and a fourth group of data voltages having a second polarity pattern in the second operation mode, wherein the second polarity pattern is different from the first polarity pattern, wherein the third and fourth groups of data voltages are generated by applying the mode selection signal having a second level directly to a second digital-to-analog converter; and applying the third group of data voltages to first group of data lines of the display panel and applying the fourth group of data voltages to the second group of data lines of the display panel.

17. The method of claim 16, wherein the first polarity pattern includes at least one first polarity and at least one second polarity arranged in a first order, and the second polarity pattern includes the at least one first polarity and the at least one second polarity arranged in a second order opposite to the first order.

* * * * *